United States Patent [19]

Witschi et al.

[11] 4,338,757

[45] Jul. 13, 1982

[54] DEVICE FOR CONNECTING A STRUCTURE WITH A WALL TO BE POURED WITH CONCRETE

[76] Inventors: Heinz Witschi, Eigerweg 14, 3073 Gümligen, Berne; Peter Fankhauser, Sonnrainstrasse 13, 3510 Konolfingen, Berne, both of Switzerland

[21] Appl. No.: 140,782

[22] Filed: Apr. 16, 1980

[30] Foreign Application Priority Data

May 1, 1979 [CH] Switzerland ..... 4073/79

[51] Int. Cl.[3] ..... E04B 1/38

[52] U.S. Cl. ..... 52/699; 52/378; 52/712

[58] Field of Search ..... 52/378, 699, 700, 712

[56] References Cited

U.S. PATENT DOCUMENTS 2,780,936 2/1957 Hillberg ..... 52/699 X

FOREIGN PATENT DOCUMENTS 1684196 4/1971 Fed. Rep. of Germany .
1312360 11/1962 France .
2142140 1/1973 France .
562376 5/1975 Switzerland .

*Primary Examiner*—Carl D. Friedman
*Attorney, Agent, or Firm*—Wigman & Cohen

[57] ABSTRACT

Before a main wall is prepared by pouring concrete, a profile element with anchor steel rods extended through its bottoms is fitted to a planking in such a way that a cavity is created between the bottoms of the profile element and the planking. The profile element has two side walls and two bottoms lying in the same plane. The anchor steel rods extended through the bottoms form U-shaped loops on the one side of the element, whereas the end portions of the anchor steel rods bent in right angles from the legs of the U-shaped portions lie on the other side of the element. The surface of the profile element is roughened and its side walls enclose each a sharp angle with the bottoms. By means of the profile element locked in the concrete of the completed main wall a groove is formed in the outer face of the concrete main wall out of which groove the end portions of the anchor steel rods can be bent outward without additional works, such as scratching-out of a plastic body as per the prior art. In this way also the adhesion ability of the connection place in the completed concrete main wall for the bondage of another structure to the main wall is enhanced.

15 Claims, 6 Drawing Figures

DEVICE FOR CONNECTING A STRUCTURE WITH A WALL TO BE POURED WITH CONCRETE

Figure 1:
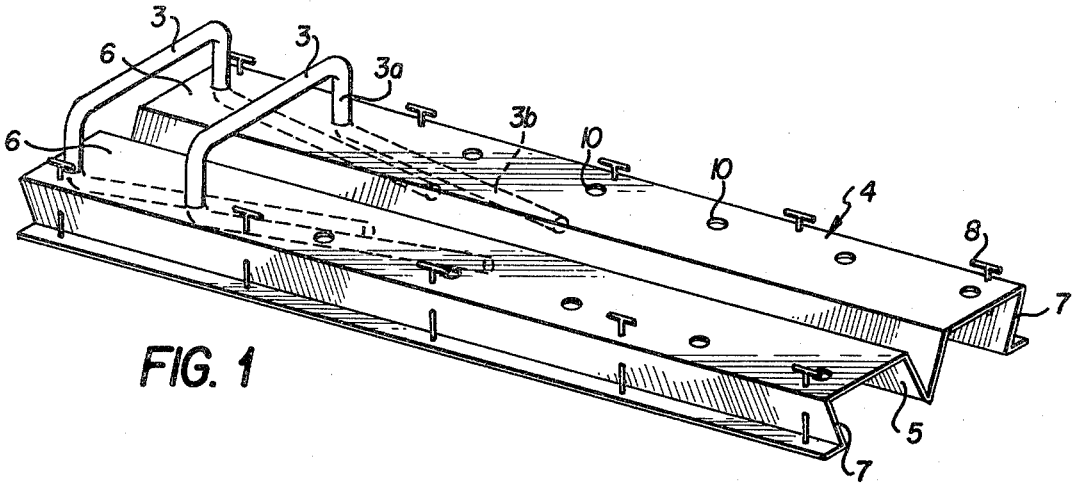

The invention relates to a device for connecting a structure, such as a partition, a staircase or a false floor, with a wall to be poured with concrete in a planking, said device comprising at least one profile element having two side walls with laterally projecting flanges and at least one bottom, at least one anchoring steel rod extended through said bottom in such a way that its first portion to be concreted lies on one side of said profile element, and its second portion, bent in right angles from the first portion, lies on the other side of said profile element resting against the bottom surface of the profile element, confined by said side walls, said profile element being fitted to the inside wall of the planking in such a way as to rest with its side walls on the planking in order to create a cavity between said bottom and said planking.

In order to bond for instance a partition, a staircase, a false floor or a balcony, to a concrete structure a pointed connection groove has to be chiselled by hammers. Such a work is difficult, time-consuming and expensive.

This problem of the building industry should have been solved by a method for the manufacture of reinforcement members according to the Swiss patent specification No. 562 376. The reinforcement members were bent into a U-form, the two arms of which were further bent into right angles, and put with their bent arms lowermost in a channel-shaped pan into which a liquid foam material has been poured. The bent arms of the reinforcement members were embedded in the solidified foam-material, whereas the U-shaped loops with their legs were projecting from the material. The loop projecting from the wider side of the two parallel sides of the foam-material body of a trapezoidal cross section was destined to be embedded in the wall to be concreted. The arms which were embedded in the foam-material body along the narrower side of the two parallel sides were destined to be bent outward.

Before the wall was concreted, such a device was fitted to the planking; thereafter the wall was poured with concrete. The U-shaped loops remained then firmly anchored in the completed wall, whereas the foam-material body came to rest on the outer surface of the wall. The foam-material body had then to be scraped out. It is known from experience that the scraping out of the foam-material body takes approximately 15 to 20 minutes in order to free the arms of the reinforcement members, when the wall has a height of 240 cm and the foam-material body has a thickness of 20 cm. Such a work is, however, time-consuming and therefore also expensive.

The French patent specification No. 2 142 140 describes a device for connecting a part with a structure to be poured with concrete; such device consists of a hard profile element made of steel sheet having a bottom and two side walls. Anchor steel rods are extended through the bottom of the profile element in such a way that one portion thereof, which is destined to be concreted, lies on the one side of the element and forms a U-shaped loop, whereas the other portion is bent from the first portion in right angles and lies on the other side of the element whereby it rests against its bottom. The profile element will be fitted with its open side against the planking so that a cavity is formed between the planking and the bottom of the element.

After the concrete poured into the planking has been set, the planking will be removed. Then the portions of the anchor steel rods resting against the inner side of the bottom are seized and straightened, whereafter the element will be removed from the concrete to be further used. In order to facilitate the removal of the element from the concrete, each of its side walls encloses an obtuse angle with the bottom of the element.

The removal of the profile element made of steel sheet from the set concrete is, however, considerably difficult and time-consuming. Apart from this, the so created groove in the outer face of the concrete wall provides no suitable adhesion surface for the part to be bonded to the structure by pouring concrete, because the side walls of the groove enclose an obtuse angle with its bottom wall.

It is the object of the invention to remove the described disadvantages of the known methods and devices providing a connection on a structure to be poured with concrete. A device is to be provided by means of which such a connection can be quickly prepared; the connection place provided by such a device should have a better adhesion ability than the connections provided by known devices. Besides, such a device should be well adapted for the transporting.

The invention solves these objects by providing a profile element consisting of malleable metal sheet or plastic the surface of which is roughened and the side walls of which enclose each a sharp angle with the bottom.

The profile element consists preferably of a perforated, punched, pressed or ribbed malleable metal sheet or plastic.

Figure 2:
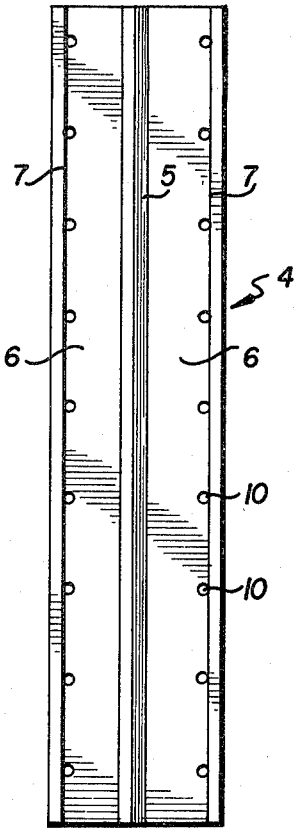
Figure 3:
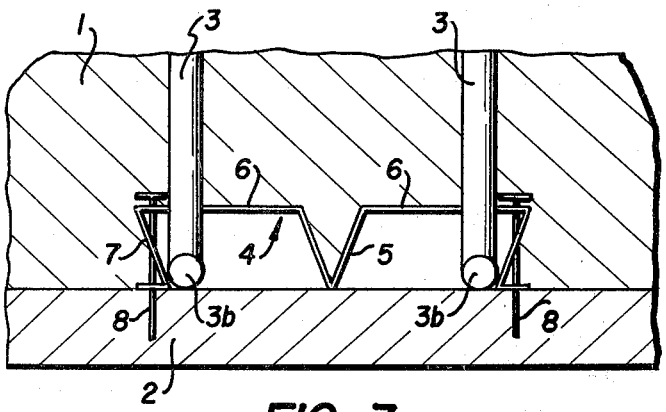
Figure 4:
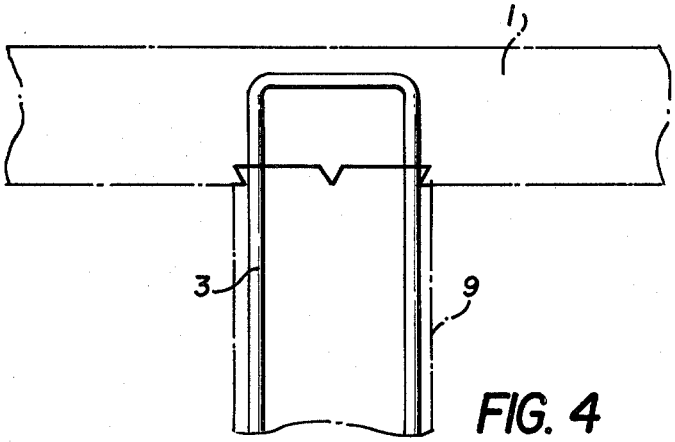
Figure 5:
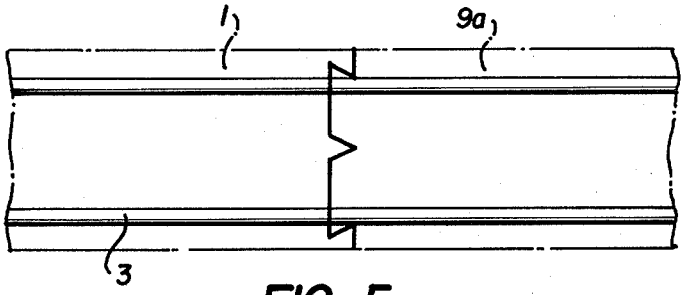
Figure 6:
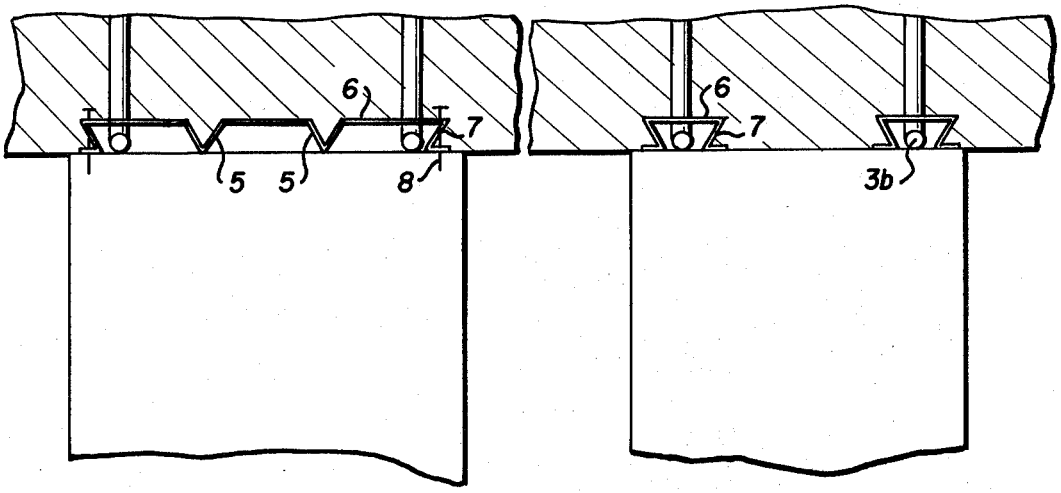

The invention will be further readily understood from the following description and drawings, in which FIG. 1 is a perspective view of an embodiment of a profile element with anchor steel rods which are formed on one side of the profile element in a U-shaped loop portion and on the other side of the profile element in end portions bent in right angles from the legs of the loop, FIG. 2 a bottom view of the profile element according to FIG. 1, FIG. 3 a horizontal section of the profile element with anchor steel rods according to FIG. 1, which element is embedded in a concrete main wall and fixed to a planking, FIGS. 4 and 5 horizontal sections of the main wall to which a partition is bonded by means of the profile element with anchor steel rods according to FIG. 1, and FIG. 6 a longitudinal section of two other embodiments of the profile element with anchor steel rods, which elements are embedded in a concrete main wall and fixed to a planking.

The profile element 4 shown in the figures consists of a steel sheet (preferably a malleable steel sheet) or of a plastic which is perforated, corrugated, punched, pressed or ribbed in order to roughen its upper surface. The regularly roughened upper surface provides namely the optimal adhesion possibility between two concrete castings when the profile element 4 is embedded in the concrete of a main wall 1, as it will be further explained. The profile element 4 the trapezoidal cross section of which is shown in the Figures comprises two side walls 7 as well as two bottoms 6 lying in the same plane, which bottoms are connected by means of a strengthening rib 5 having the form of V in cross section. The strengthening rib 5 can be shaped as required; it is destined to take the pressure exerted by the concrete on the profile element 4 embedded in the concrete. The side walls 7 each enclose an angle of approximately 60° with the bottoms 6; owing to this there is provided a perfect connection place for a structure to be bonded to the completed main wall. As it can be seen from FIG. 6 there can be provided only one single profile element or more of them. The profile element 4 can have a meander, a zig-zag or a wave-like cross section and including combinations of these forms.

Anchor steel rods 3 are extended through openings 10 punched in the bottoms 6 of the profile element 4. On the one side of the profile element 4 the anchor steel rods 3 form U-shaped loop portions 3*a*, whereas the end portions 3*b* of the anchor steel rods 3 are bent in right angles in a predetermined distance from these loop portions and rest against the bottom surface confined by the side walls 7 on the other side of the profile element 4. The U-shaped loop portions 3*a* are destined to be embedded in the main wall 1 to be concreted. After the concrete has been poured and set the end portions 3*b* of the anchor steel rods 3 will be bent outward in right angles so that they are thereafter in the same line with the legs of the U-shaped loop portions locked in the concrete. The anchor steel rods need not be, however, formed in U-shaped loop portions. The loop portions can have the form of Omega, or there can be provided hooks instead of loops or only straight-lined end portions, as required. A single anchor steel rod must be always provided with a loop portion.

The process of the preparation of the main wall 1 by pouring concrete is as follows.

First the profile element 4 with the anchor steel rods 3 extended therethrough is fitted to the inside wall of a planking 2 in such a way that there will be created a cavity between the profile element 4 and the inside wall of the form wall 2. Such a cavity is limited by the bottoms 6 and the side walls 7 of the profile element 4 and the planking 2, whereby the side walls 7 rest against the inside wall of the planking 2. Then concrete will be poured into the planking 2 outside the cavity. The U-shaped loop portions 3*a* of the anchor steel rods 3 with the respective legs are locked in the concrete of the main wall 1. After the planking 2 has been removed there will remain a groove in the outer face of the concrete main wall 1, where the embedded profile element 4 remains. The free end portions 3*b* of the anchor steel rods 3 will be bent outward in right angles from the groove with difficulty. A partition 9, 9*a* or another structure which has to be bonded to the main wall 1 is then concreted.

As the width of the profile element 4 is smaller than the thickness of the partition 9, 9*a*, there is formed a clean groove as connection place between the partition 9, 9*a* and the main wall 1.

In order to allow a quick mounting of the profile element 4 before concrete is poured, fixing pins 8 are inserted through the bottoms 6 and driven into the planking 2.

The form of the anchor steel rods (U-shaped or Omega-shaped loops or hooks or straight-lined end portions) are to be specified by the respective civil engineers in advance, so that these types of anchor steel rods and the profile element could be prefabricated in time.

For transport purposes the end portions 3*b* of the anchor steel rods 3 will be spot welded so that they are held on each other without movement, or a plastic foil can be stretched over the side walls 7.

In this way the scraping-out of the foam-material body of the connection place in the main wall can be eliminated. The manufacturing costs of the profile element made of metal or plastic are thereby not higher than the manufacturing costs of the foam-material body. The end portions of the anchor steel rods can be bent outward from the groove on the outer face of the completed main wall quickly and without problems. There remain no plastic remnants in the corners of the dovetail groove formed by the foam-material body, as it is the case with the described prior art, which fact renders the bonding of the joining wall to the main structure difficult.

Because the profile element is locked in the concrete of the structure and is not removed from the same, the difficult and time-consuming works in connection with the removal of the profile element from the concrete structure are saved. The so formed groove in the outer face of the completed concrete structure has a better adhesion ability for another structure to be bonded to the main structure by pouring concrete. By means of the foil stretched over both the side walls of the profile element the concrete being poured is prevented from entering into the cavity between the planking and the bottom of the profile element. In this case the profile element can be fitted to the planking without having been fixed thereto by means of pins.

We claim:

1. A device for connecting a structure, such as a partition, a staircase or a false floor, with a wall to be poured with concrete in a planking, said device comprising at least one profile element having two side walls with laterally projecting flanges and at least one bottom connected with said two side walls to form a channel-shaped strip, at least one anchoring steel rod extended through said bottom in such a way that its first portion to be concreted lies on one side of said profile element, and its second portion, bent in right angles from the first portion, lies on the other side of said profile element resting against the bottom surface of the profile element confined by said side walls, said profile element being fitted to the inside wall of the planking in such a way as to rest with its side walls on the planking in order to create a cavity between said bottom and said planking, wherein the profile element comprises a malleable sheet the surface of which is roughened and each side wall of which encloses an acute angle with the bottom.

2. The device according to claim 1 wherein the profile element is provided with at least one strengthening rib.

3. The device according to claim 2, wherein said strengthening rib extends from said bottom into contact with said planking when said profile element is fitted thereto.

4. The device according to claim 1, wherein fixing pins are inserted through the bottom of the profile element and into said planking to secure said element thereto.

5. The device according to claim 1, wherein a foil is stretched over both the side walls of the profile element by means of which a closed cavity is formed between the bottom of the profile element and said foil.

6. The device according to claim 1, wherein said malleable sheet is metal.

7. The device according to claim 6, wherein the roughened surface of the metal sheet comprises a perforated surface.

8. The device according to claim 6, wherein the roughened surface of the metal sheet comprises a punched surface.

9. The device according to claim 6, wherein the roughened surface of the metal sheet comprises a pressed surface.

10. The device according to claim 6, wherein the roughened surface of the metal sheet comprises a ribbed surface.

11. The device according to claim 1, wherein said malleable sheet is plastic.

12. The device according to claim 11, wherein the roughened surface of the plastic sheet comprises a perforated surface.

13. The device according to claim 11, wherein the roughened surface of the plastic sheet comprises a punched surface.

14. The device according to claim 11, wherein the roughened surface of the plastic sheet comprises a pressed surface.

15. The device according to claim 11, wherein the roughened surface of the plastic sheet comprises a ribbed surface.

* * * * *

REEXAMINATION CERTIFICATE (340th)

United States Patent [19] [11] B1 4,338,757

Witschi et al. [45] Certificate Issued Apr. 16, 1985

[54] DEVICE FOR CONNECTING A STRUCTURE WITH A WALL TO BE POURED WITH CONCRETE

[76] Inventors: Heinz Witschi, Eigerweg 14, 3073 Gümligen, Berne; Peter Fankhauser, Sonnrainstrasse 13, 3510 Konolfingen, Berne, both of Switzerland

Reexamination Request:
No. 90/000,393, Jun. 10, 1983

Reexamination Certificate for:

| | |
|---|---|
| Patent No.: | **4,338,757** |
| Issued: | **Jul. 13, 1982** |
| Appl. No.: | **140,782** |
| Filed: | **Apr. 16, 1980** |

[30] Foreign Application Priority Data

May 1, 1979 [CH] Switzerland ..... 4073/79

[51] Int. Cl.[3] ..... E04B 1/38

[52] U.S. Cl. ..... 52/699; 52/378; 52/712

[58] Field of Search ..... 52/378, 379, 699, 710

[56] References Cited

U.S. PATENT DOCUMENTS

| | | | |
|---|---|---|---|
| 827,613 | 7/1906 | Brown | 52/710 |
| 1,281,416 | 10/1918 | Pratt | 52/710 |
| 1,623,338 | 4/1927 | Goldsmith | 52/378 X |
| 1,641,147 | 9/1927 | Barton | 52/379 X |
| 2,006,300 | 6/1935 | Kinninger | 52/710 X |
| 2,075,262 | 3/1937 | Boettner | 52/699 X |
| 2,780,936 | 2/1957 | Hillberg | 52/699 |
| 4,010,586 | 3/1977 | Brechbuhler | 52/378 X |

FOREIGN PATENT DOCUMENTS

| | | | |
|---|---|---|---|
| 645666 | 10/1928 | France | 52/710 |
| 909298 | 10/1962 | United Kingdom | 52/699 |
| 929291 | 6/1963 | United Kingdom | 52/699 |

*Primary Examiner*—Alfred C. Perham

[57] ABSTRACT

Before a main wall is prepared by pouring concrete, a profile element with anchor steel rods extended through its bottoms is fitted to a planking in such a way that a cavity is created between the bottoms of the profile element and the planking. The profile element has two side walls and two bottoms lying in the same plane. The anchor steel rods extended through the bottoms form U-shaped loops on the one side of the element, whereas the end portions of the anchor steel rods bent in right angles from the legs of the U-shaped portions lie on the other side of the element. The surface of the profile element is roughened and its side walls enclose each a sharp angle with the bottoms. By means of the profile element locked in the concrete of the completed main wall a groove is formed in the outer face of the concrete main wall out of which groove the end portions of the anchor steel rods can be bent outward without additional works, such as scratching-out of a plastic body as per the prior art. In this way also the adhesion ability of the connection place in the completed concrete main wall for the bondage of another structure to the main wall is enhanced.

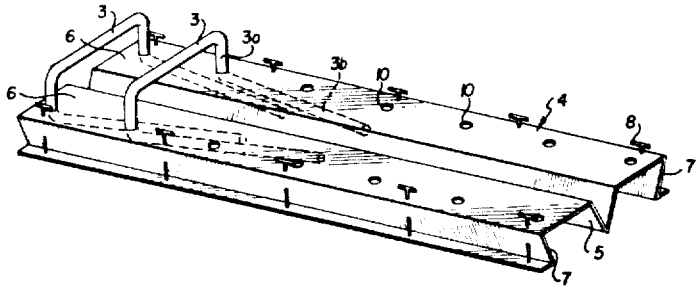

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is cancelled.

Claims 2, 4–6 and 11 are determined to be patentable as amended.

Claims 3, 7–10 and 12–15, dependent on an amended claim, are determined to be patentable.

New claims 16–21 are added and determined to be patentable.

2. The device according to claim [1] *16* wherein the profile element is provided with at least one strengthening rib having the form of a V in cross-section.

4. The device according to claim [1] *16* wherein fixing pins are inserted through the bottom of the profile element and into said planking to secure said element thereto.

5. The device according to claim [1] *16* wherein a foil is stretched over both the side walls of the profile element by means of which a closed cavity is formed between the bottom of the profile element and said foil.

6. The device according to claim [1] *16* wherein said malleable sheet is metal.

11. The device according to claim [1] *16* wherein said malleable sheet is plastic.

*16. A device for connecting two poured concrete structures, such as a partition, a staircase or a false floor with a wall to be poured with concrete in a planking, said device comprising at least one profile element comprising a malleable sheet the surface of which is provided with roughening means for optimizing adhesion of said sheet with said concrete structures, said profile element having two side walls with laterally projecting flanges and at least one bottom connected with said two side walls to form a channel-shaped strip, each of said side walls enclosing an acute angle with said bottom, at least one anchoring steel rod extended through said bottom such that a first portion of said rod to be concreted with a first one of said two concrete structures is disposed on one side of said profile element and a second portion of said rod to be concreted with the second of said two concrete structures is disposed on the other side of said profile element, said second portion having a bend at a substantially right angle from said first portion such that said second rod portion lies against the bottom of said profile element confined by said side walls, said second rod portion being adapted to be bent outwardly away from said bottom for concreting with said second concrete structure, said profile element being fitted to the inside wall of said planking such that said side walls bear on the planking and form a cavity between said bottom and said planking, the length of said second rod portion being greater than the distance between said bottom and said planking.*

*17. The device according to claim 16 wherein the bottom of said profile element is provided with at least one strengthening rib extending longitudinally thereof, said rib extending from said bottom across said cavity and into contact with said planking.*

*18. A device for connecting two poured concrete structures, such as a partition, a staircase or a false floor with a wall to be poured with concrete in a planking, said device comprising at least one profile element comprising a malleable sheet the surface of which is provided with roughening means for optimizing adhesion of said sheet with said concrete structures, said profile element having two side walls with laterally projecting flanges and at least one bottom connected with said two side walls to form a channel-shaped strip, each of said side walls enclosing an acute angle with said bottom, at least one anchoring steel rod extended through said bottom such that a first portion of said rod to be concreted with a first one of said two concrete structures is disposed on one side of said profile element and a second portion of said rod to be concreted with the second of said two concrete structures is disposed on the other side of said profile element, said second portion having a bend at a substantially right angle from said first portion such that said second rod portion lies against the bottom of said profile element confined by said side walls, said profile element being fitted to the inside wall of said planking such that said side walls bear on the planking and form a cavity between said bottom and said planking, the bottom of said profile element being provided with at least one strengthening rib extending longitudinally thereof, said rib extending from said bottom across said cavity and into contact with the inside wall of said planking.*

*19. The device according to claim 18 wherein said strengthening rib is V-shaped in cross-section.*

*20. A device for connecting two poured concrete structures, such as a partition, a staircase or a false floor with a wall to be poured with concrete in a planking, said device comprising at least one profile element comprising a malleable sheet the surface of which is provided with roughening means for optimizing adhesion of said sheet with said concrete structures, said profile element having two side walls with laterally projecting flanges and at least one bottom connected with said two side walls to form a channel-shaped strip, each of said side walls enclosing an acute angle with said bottom, at least one anchoring steel rod extended through said bottom such that a first portion of said rod to be concreted with a first one of said two concrete structures is disposed on one side of said profile element and a second portion of said rod to be concreted with the second of said two concrete structures is disposed on the other side of said profile element, said second portion having a bend at a substantially right angle from said first portion such that said second rod portion lies against the bottom of said profile element confined by said side walls, said second rod portion being of a length sufficient to be bent outwardly away from said bottom for anchoring in the concrete of said second concrete structure, said profile element being fitted to the inside wall of said planking such that said side walls bear on the planking and form a cavity between said bottom and said planking, said profile element being provided with at least one strengthening rib having the form of a V in cross-section, said strengthening rib extending from said bottom into contact with said planking when said profile element is fitted thereto.*

*21. A device for connecting two poured concrete structures, such as a partition, a staircase or a false floor with a*

*wall to be poured with concrete in a planking, said device comprising at least one profile element comprising a malleable sheet the surface of which is provided with roughening means for optimizing adhesion of said sheet with said concrete structures, said profile element having two side walls with laterally projecting flanges and at least one bottom connected with said two side walls to form a channel-shaped strip, each of said side walls enclosing an acute angle with said bottom, at least one anchoring steel rod extended through said bottom such that a first portion of said rod to be concreted with a first one of said two concrete structures is disposed on one side of said profile element and a second portion of said rod to be concreted with the second of said two concrete structures is disposed on the other side of said profile element, said second portion having a bend at a substantially right angle from said first portion such that said second rod portion lies against the bottom of said profile element confined by said side walls, said second rod portion being of a length sufficient to be bent outwardly away from said bottom for anchoring in the concrete of said second concrete structure, said profile element being fitted to the inside wall of said planking such that said side walls bear on the planking and form a cavity between said bottom and said planking, the bottom of said profile element being provided with at least one strengthening rib extending longitudinally thereof, said rib extending from said bottom across said cavity and into contact with said planking.*

* * * * *